US007159373B2

(12) United States Patent
Blanc

(10) Patent No.: US 7,159,373 B2
(45) Date of Patent: Jan. 9, 2007

(54) INSTALLATION FOR HYDRAULICALLY FILLING CRATES WITH FLOATING OBJECTS SUCH AS FRUITS AND HAVING A SINGLE DOUBLE-ACTING PUMP

(75) Inventor: Philippe Blanc, Montauban (FR)

(73) Assignee: Material Pour l'Arboriculture Fruitiere, Montauban (FR)

( * ) Notice: Subject to any disclaimer, the term of this patent is extended or adjusted under 35 U.S.C. 154(b) by 31 days.

(21) Appl. No.: 11/084,000

(22) Filed: Mar. 21, 2005

(65) Prior Publication Data

US 2005/0210831 A1 Sep. 29, 2005

(30) Foreign Application Priority Data

Mar. 23, 2004 (FR) ..... 04 02981

(51) Int. Cl.
*B65B 25/04* (2006.01)

(52) U.S. Cl. ..... 53/244; 53/248

(58) Field of Classification Search ..... 53/244, 53/248, 175, 145; 141/70; 209/925; 406/106
See application file for complete search history.

(56) References Cited

U.S. PATENT DOCUMENTS 1,744,363 A * 1/1930 Chapman ..... 414/416.09
3,178,867 A * 4/1965 Martin, Jr. ..... 53/248
3,337,049 A * 8/1967 Carlsen ..... 209/665
3,470,670 A * 10/1969 Gorin ..... 53/473
3,550,347 A * 12/1970 Coates ..... 53/473
3,565,250 A * 2/1971 Ross et al. ..... 209/705
3,643,400 A * 2/1972 Barbet ..... 53/248
3,656,272 A 4/1972 Sheetz
3,694,996 A * 10/1972 Carlsen ..... 53/473
4,051,645 A * 10/1977 Warkentin ..... 53/248
4,807,422 A * 2/1989 Blanc ..... 53/248
5,242,250 A * 9/1993 Compagnoni ..... 406/73

FOREIGN PATENT DOCUMENTS

EP 0 670 276 A1 9/1995
FR 2 036 095 3/1969
FR 2 596 728 10/1987
FR 2 664 566 1/1992
FR 2 689 856 10/1993
GB 1 230 239 4/1971
GB 1571400 A * 7/1980

* cited by examiner

*Primary Examiner*—Stephen F. Gerrity
(74) *Attorney, Agent, or Firm*—Young & Thompson

(57) ABSTRACT

The invention relates to an installation for hydraulically filling crates (1) with floating objects such as fruits, comprising a tank (2) for receiving at least one crate (1), a device (3) for loading/unloading a crate/crates into/from the tank (2) and at least one supply channel (13) of a hydraulic flow transporting the floating objects. At least one bypass branch from at least one supply channel (13) is provided at the entrance and in the upper portion of the tank (2), so as to divide the supply delivery to form the filling delivery and a bypass delivery, these two deliveries being supplied to the intake of a double-acting pump (26) serving as a filling pump and a supply pump.

11 Claims, 5 Drawing Sheets

INSTALLATION FOR HYDRAULICALLY FILLING CRATES WITH FLOATING OBJECTS SUCH AS FRUITS AND HAVING A SINGLE DOUBLE-ACTING PUMP

FIELD OF THE INVENTION

The invention relates to an installation for hydraulically filling crates, in particular crates permeable to water such as slatted crates and/or pallet crates (also referred to by the term "palox"), for storing or transporting large quantities (typically several hundred kilos) of fruit or vegetables or other floating objects.

Throughout the text the term "installation" refers to an assembly of devices and/or objects and/or machines and/or equipment and/or automatic systems and/or premises and/or buildings, etc., installed and arranged for the purpose of a determinate use.

BACKGROUND OF THE INVENTION

Already known (FR-2036095, FR-2596728) are devices for filling crates with floating objects such as fruits, for example apples. Such a device includes a receiving tank for a crate to be filled, a device for loading/unloading a crate into/from the tank and a supply channel of a hydraulic flow to an upper portion of the tank. A pump is provided for drawing the liquid flow from the bottom of the tank and thus providing a throughput through the tank in order to fill the crate with objects floating in the flow arriving in the supply channel. In practice, this pump is a centrifugal pump, necessitating the use of an upstream filter and selected solely in order to provide an appropriate filling delivery for the tank.

In an installation incorporating such a filling device, another pumping circuit supplied by one or more other pump(s) must be provided to form the supply delivery circulating in the supply channel, with an upstream bypass branch dividing said supply delivery into a part forming the filling delivery and another part forming a bypass delivery, which does not pass through the tank and is generally recycled into another tank upstream of the supply channel. In practice, the filling delivery must be selected to ensure filling of the crate as rapidly as possible but nevertheless without risk of damaging the floating objects. The supply delivery in its turn is so determined as to ensure transportation of the floating objects to the entrance of the tank and depends on factors independent of the filling circuit, in particular the number of accumulation channels opening into the supply channel and continuously supplying it with water. In general, the amount of the supply delivery is therefore far greater than that of the filling delivery. The necessary use of several different pumps, and in particular a centrifugal pump with a specific upstream filter for the supply delivery, adds significantly to the cost of such an installation.

OBJECT OF THE INVENTION

It is the object of the invention to mitigate these disadvantages by proposing an installation for hydraulically filling crates—in particular permeable crates—with floating objects that is simpler and less costly than the preceding installations.

In particular, it is an object of the invention to simplify the construction of pumping circuits, while permitting appropriate adjustment of each delivery, in a simple and economical manner.

It is also an object of the invention to reduce the maintenance operations and costs of such an installation.

SUMMARY OF THE INVENTION

To achieve these objects, the invention relates to an installation for hydraulically filling crates with floating objects such as fruits, comprising:

- a tank for receiving at least one crate to be filled;
- a device for loading/unloading a crate/crates into/from the tank;
- at least one supply channel for a hydraulic flow able to transport floating objects and connected to the tank to supply same;
- a first pumping circuit, called the supply circuit, able to maintain in each supply channel a hydraulic delivery, called the supply delivery, appropriate for transporting floating objects to the tank;
- a second pumping circuit, called the filling circuit, able to maintain a hydraulic delivery, called the filling delivery, through the tank and into each crate contained therein so as to introduce the transported floating objects thereto,
- the filling circuit including at least one water outlet from the tank and supplying a pump able to provide the filling delivery, wherein:
- the supply circuit includes at least one bypass branch from at least one supply channel at its entrance to an upper portion of the tank, so as to divide the total supply delivery arriving at a downstream end of said supply channel connected to the tank into a first component forming the filling delivery and a second component forming a bypass delivery that does not pass through the tank;
- it includes a pump, called a double-acting pump, adapted to act at the same time as a filling pump for the filling circuit and a supply pump for the supply circuit, the filling and supply circuits being adapted to feed said double-acting pump, firstly with the filling delivery emerging from the water outlet(s) of the tank and, secondly, with the bypass delivery.

According to the invention the installation advantageously includes a single pump, constituted by the double-acting pump, providing the totality of the hydraulic circulation in the filling circuit and in each supply channel.

In addition, according to the invention the installation advantageously includes means for controlling the amount of the bypass delivery supplying the double-acting pump. These control means are advantageously formed by a device for controlling the effective cross-section of flow of the bypass delivery for feeding the double-acting pump.

To achieve this, according to the invention the installation advantageously provides that the double-acting pump includes an intake connected to a supply port formed through a wall of a bypass tank that receives the bypass delivery, that the water outlet(s) of the tank supplies/supply a return conduit extending into the bypass tank and having an open end opening into the supply port, and that the cross-section of the supply port is greater than that of the end of the return conduit, so that a passage is formed between them for the bypass delivery feeding the double-acting pump.

According to the invention the end of the return conduit is preferably centered axially on the supply port. The supply port is therefore of the coaxial type, the return conduit supplying the filling delivery being centered on the axis of the supply port and the bypass delivery being supplied radially outside and around the end of the return conduit. According to the invention the control device advantageously includes a control ring disposed around the end of the return conduit and adapted to slide along this conduit, its dimensions corresponding to those of the supply port, and means for maintaining the control ring in position (fixed but adjustable) with respect to the supply port. These position-maintaining means are advantageously formed by length-adjustable stops joined to the control ring and bearing against the wall of the bypass tank.

Furthermore, according to the invention the installation advantageously includes a device for adjusting the amount of the filling delivery supplying the double-acting pump from each water outlet of the tank. This adjusting device is advantageously also a device for varying the effective cross-section of flow of the filling delivery in the return conduit, in particular a valve.

Furthermore, according to the invention the double-acting pump is advantageously an axial-flow pump. This double-acting pump, which must provide at the same time the filling delivery and the bypass delivery, i.e. the total supply delivery, is in fact compatible with the performance and characteristics of axial-flow pumps. This results in a simplification with regard to maintenance (in particular through the absence of an upstream filter), and in improved output, pumping efficiency and reliability as compared to the centrifugal pumps previously used to provide the filling delivery. According to the invention the installation advantageously includes a single supply channel and a single bypass branch from the supply channel at its entrance to the tank.

However, the invention is also applicable to an installation including a plurality of supply channels distributed around the tank. In this case the filling delivery may be formed either by a component of the delivery of each supply channel provided with a bypass branch, or by the delivery or a component of the delivery of only some of the supply channels (i.e. only certain channels among them).

In addition, according to the invention the supply circuit is advantageously adapted to recycle the total delivery supplied by the double-acting pump upstream of the supply channel(s). In this way the single double-acting pump provides the totality of the water circulation in the installation.

In an advantageous embodiment according to the invention the installation includes:

- a container fed by the total delivery supplied by the double-acting pump;
- a plurality of channels, called accumulation channels, connected to the container so as to be supplied with water from said container, and distributed regularly along the supply channel to supply it with water;
- a unit for selectively supplying each accumulation channel with floating objects.

The invention extends to include an installation wherein there are in combination all or some of the characteristics mentioned hereinbefore or hereinafter.

BRIEF DESCRIPTION OF THE DRAWINGS

Other objectives, characteristics and advantages of the invention will be apparent from the following description of one of its embodiments, given solely as a non-limiting example with reference to the appended drawings, in which.

DETAILED DESCRIPTION OF THE INVENTION

Figure 1:
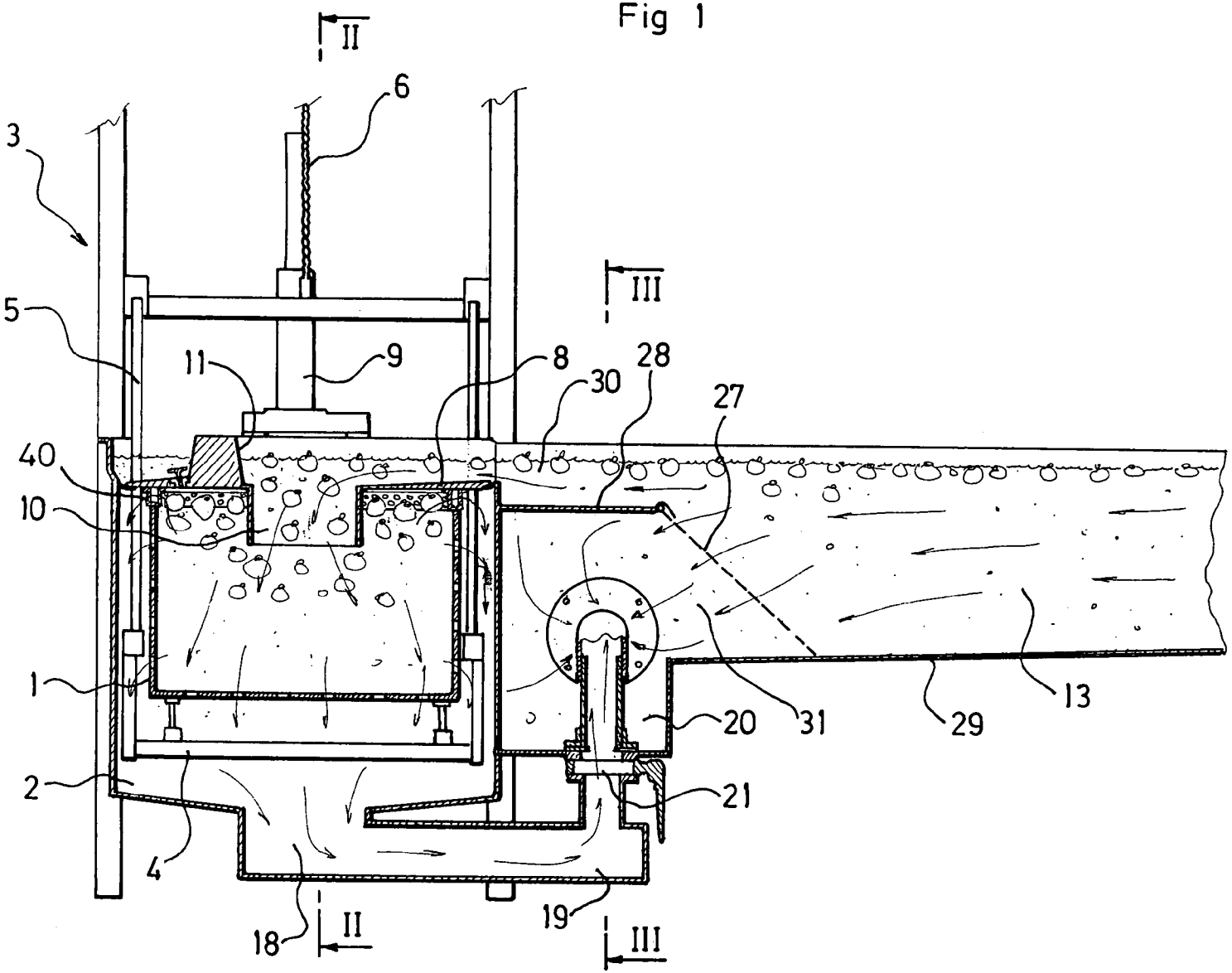
FIG. 1 is a schematic vertical sectional view of a part of an installation according to the invention including a filling device.

FIG. 1 shows the filling device of an installation for hydraulically filling crates 1, such as slatted crates or pallet crates (also referred to as "palox"), for storing or transporting floating objects such as fruits or vegetables. Typically, the pallet crates have a capacity of several hundred kilograms and allow, for example, fruit to be stored after sizing and sorting before being packed in boxes. The crates 1 are generally water-permeable, but the invention also applies to crates 1 which are not completely permeable. For example, wooden crates have little permeability when new but can be filled using an installation according to the invention.

The installation comprises a watertight tank 2 for receiving a crate 1 to be filled, and a device 3 for loading/unloading the crate 1 into/from the tank 2 from above. This device 3 includes, for example, a base 4 on which the crate 1 can rest by means of rollers, said base being integral with a lifting frame 5 suspended on chains 6 moved by a motor 7 which enables the assembly of the frame 5 supporting a crate 1 to be raised or lowered. In addition, the frame 5 carries a plate 8 forming a cover by means of a vertical actuator 9 which enables said plate 8 to be placed on a crate 1 immersed in the tank 2. This plate 8 is provided with an opening 10 having a vertical axis for supplying the crate 1, and profiled guides 11 enabling floating objects to be guided towards this opening 10, the whole arrangement being as described, for example, by FR-2596728. The plate 8 is supported on the upper edges of the crate 1 by means of a metal frame 40 carried by the plate 8. This frame is formed by perforated rails through which water can pass when overflowing the upper edges of the crate 1, in particular if the latter has little or no permeability to water.

Figure 2:
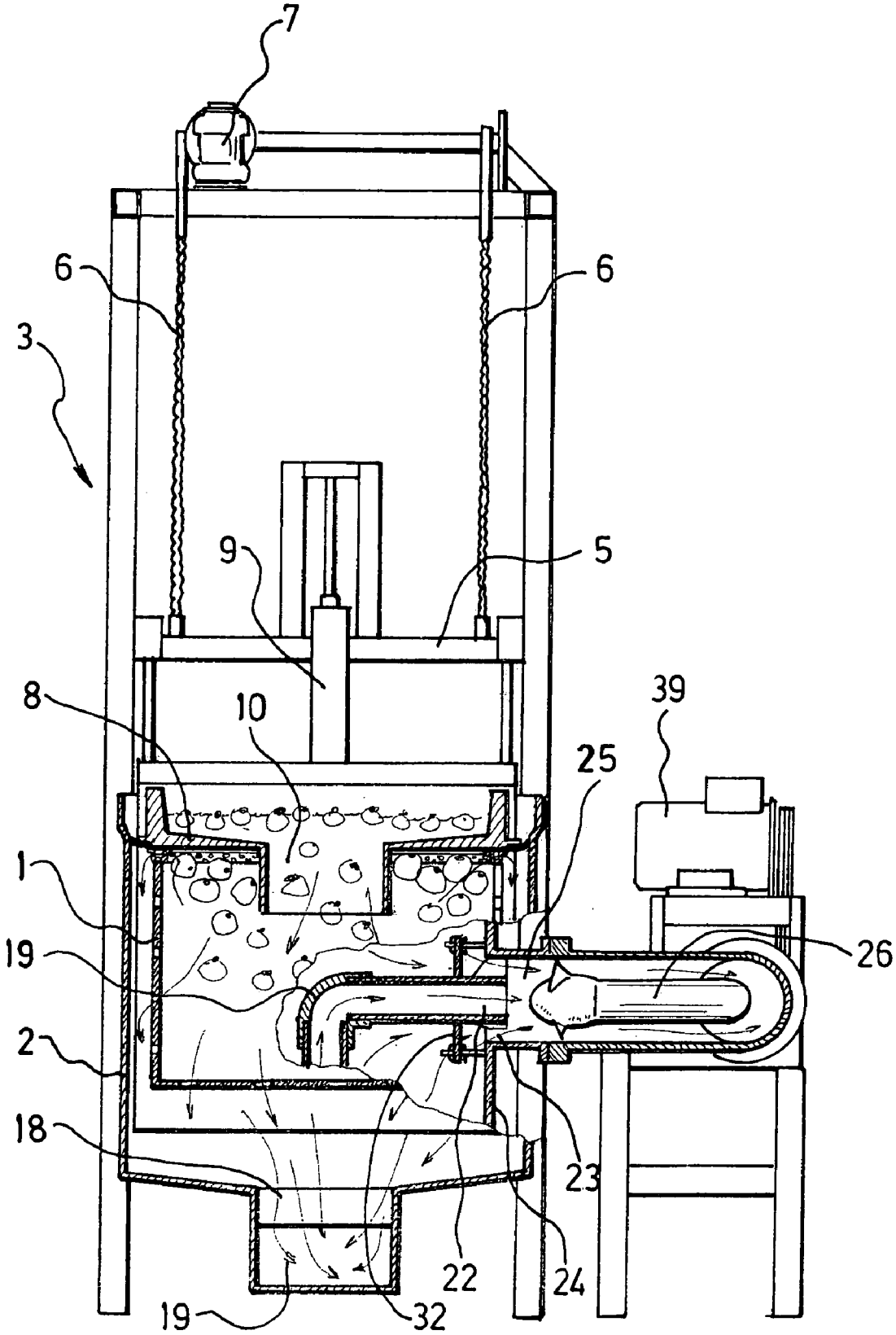
FIG. 2 is a schematic vertical sectional view along the line II—II of FIG. 1, with a partial section along the line III—III showing an axial section through the double-acting pump and its supply port.

The filling device 12 shown in FIGS. 1 and 2 is arranged at the downstream end of a supply channel 13 delivering a hydraulic flow able to transport floating objects, said channel 13 being connected to and opening into the upper portion of the tank 2 to supply it with water.

Said supply channel 13 is itself supplied from a plurality of channels, called accumulation channels 14, extending perpendicularly to the supply channel 13 into which they open. The accumulation channels 14 are distributed regularly along the supply channel 13 to supply it with water and floating objects. It should be noted in this regard that the height of the transverse cross-section of the supply channel 13 increases from upstream to downstream so as to be able to absorb the regularly increasing delivery from the various accumulation channels 14 in which a circulation of water is maintained continuously.

Figure 3:
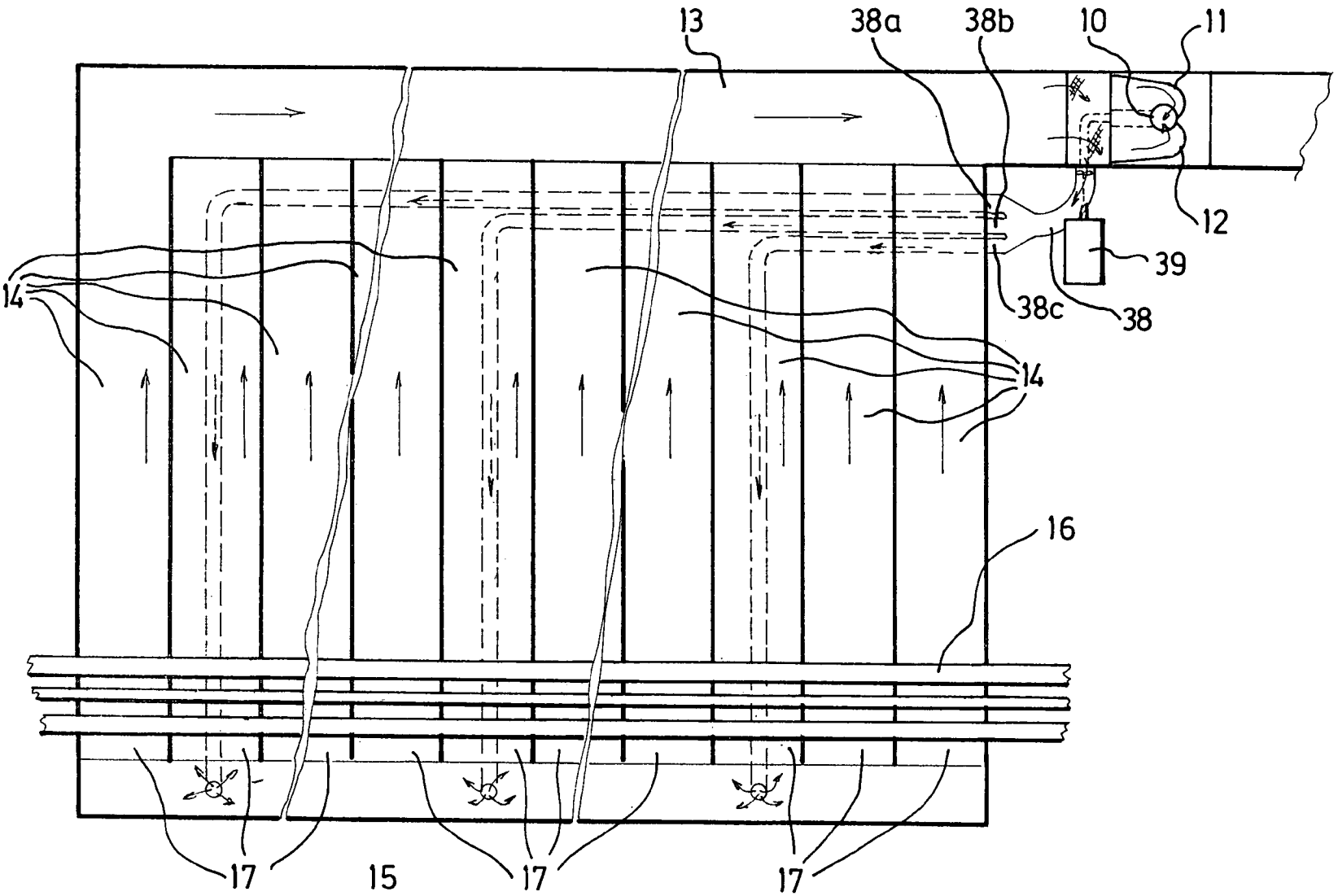
FIG. 3 is a schematic plan view of an example of a layout of an installation according to the invention.

The various accumulation channels 14 are themselves supplied with water from a container 15 which, in the example shown in FIG. 3, is formed simply by a tank extending parallel to the supply channel 13 perpendicularly to the accumulation channels 14 at the upstream ends of said accumulation channels 14, which are in communication with said longitudinal tank 15.

A sizing/sorting unit 16 extends above the upstream portions 17 of the accumulation channels 14 in order to release into the latter the floating objects which are to be transported to the filling device 12. The plurality of accumulation channels 14 allows selection of the floating objects sized by the unit 16 which are to be transported to a crate 1 in the filling device 12.

The sizing/sorting unit 16 is, for example, of the type described in EP-0670276. This unit 16 is a unit for selectively feeding each accumulation channel 14 with floating objects having predetermined characteristics. Each accumulation channel 14 is provided with a device (not shown) for retaining/releasing floating objects that it receives in its upstream portion 17, said device being adapted either to retain the floating objects in this upstream portion 17, i.e. not to allow them to be entrained by the flow of water in the accumulation channel 14, or to release said floating objects so that they are entrained by said flow of water towards the supply channel 13 and the filling device 12. This retaining/releasing device may be formed by a simple grating extending transversely to the accumulation channel 14 and mounted to pivot between a vertical position in which it prevents the floating objects from passing and a folded-down, horizontal position in which it allows the floating objects to circulate.

The tank 2 of the filling device 12 includes a water outlet 18 at the bottom of the tank, which outlet 18 supplies a return conduit 19 connected to a lateral bypass tank 20 adjoining the tank 2 directly below the junction of the supply channel 13 with the tank 2, as shown in FIG. 1. The return conduit 19 passes through the bottom of the bypass tank 20 via a flow-control valve 21. The return conduit 19 is prolonged into the interior of the bypass tank 20 by a pipe bent horizontally so as to have an open end 22 that opens horizontally opposite a supply port 23 formed through a vertical wall 24 of the bypass tank 20, to which supply port 23 the intake 25 of an axial-flow pump 26 is connected.

In this way the filling delivery taken from the bottom of the tank 2 via the outlet 18 and the return conduit 19 is drawn in by the axial-flow pump 26 via the flow-control valve 21 and the end 22 of the return conduit 19.

The axial-flow pump 26 is driven by an electric motor 39 via a belt (not shown) coupled to the rotor of the pump 26.

Conventionally for an axial-flow pump, the rotor receives the flow axially at the inlet 25 and delivers it to a bent outlet pipe 38. The rotor passes through the wall of this outlet pipe 38 in order to be coupled to the drive belt.

The bypass tank 20 is also supplied directly by a bypass delivery coming from the supply channel 13, said bypass delivery not passing through the tank 2 or the crate 1 to be filled. To this end the lower portion of the downstream end of the supply channel 13 at its junction with the tank 2 is provided with an inclined grating 27 communicating with the upper portion of the bypass tank 20, as shown in FIG. 1. This grating 27 prevents floating objects from themselves being drawn into the bypass tank 20. However, it allows water to pass through freely.

The end 22 of the return conduit 19 has a transverse cross-section smaller than that of the supply port 23, so that the water present in the bypass tank 20 can also be drawn in by the axial-flow pump 26 via the peripheral space extending between the end 22 of the return conduit 19 and the peripheral edge of the supply port 23. The end 22 of the return conduit 19 is preferably aligned axially on the axis of the supply port 23. In this way the supply port 23 provides coaxial feeding of the pump 26, firstly by the filling delivery coming from the return conduit 19 and secondly by the bypass delivery coming from the bypass tank 20 taken directly from the supply channel 13.

The supply tank 20 has a horizontal upper wall 28 extending transversely over the width of the supply channel 13 at a depth adapted to define in said supply channel 13 a useful transverse cross-section of the supply channel 13 above the wall 28 corresponding to the maximum filling delivery which must circulate in the tank 2 to fill a crate 1. This upper horizontal wall 28 of the bypass tank 20 is prolonged in the upstream direction and downwardly by the inclined grating 27 to the bottom 29 of the supply channel 13. In this way the bypass tank 20, with said upper wall 28 and the grating 27, forms a bypass branch leading from the supply channel 13 at the upper portion of the tank 2, which bypass branch divides the total supply delivery arriving at the downstream end of the supply channel 13 connected to the tank 2 into a first component 30 forming the filling delivery and a second component 31 forming the bypass delivery that does not pass through the tank 2.

The filling delivery corresponds to a flow of water flowing from above to below in the tank 2, from the junction of the supply channel 13 in the upper portion of the tank 2 above the plate 8 (when the latter is placed on a crate 1), through the opening 10 in the plate 8 and into the crate 1—in particular through the crate 1 when the latter is permeable—to emerge through the outlet 18 at the bottom of the tank. The floating objects are entrained into the crate 1 by this flow via the opening 10 in the plate 8 and progressively fill the crate 1. If the crate 1 is not permeable the water emerges from it by overflowing through the upper frame 40.

The effective cross-section of flow of the bypass delivery supplying the pump 26 can be controlled by means of a control ring 32 arranged around the end 22 of the return conduit 19. The control ring 32 has a central opening conjugate to the shape of the cross-section of the return conduit 19 and can slide along said return conduit 19. The control ring 32 also has a radial dimension greater than that of the supply port 23. In this way the control ring 32 is able to fully cover the supply port 23 when it bears against said supply port 23. The end 22 of the return conduit 19 is preferably positioned so as to pass through the wall 24 of the bypass tank 20 containing the supply port 23, i.e. to extend partially through the supply port 23. In this way the control ring 32 can slide fully until it bears against said wall 24 of the bypass tank 20 while being guided by the return conduit 19.

Figure 5:
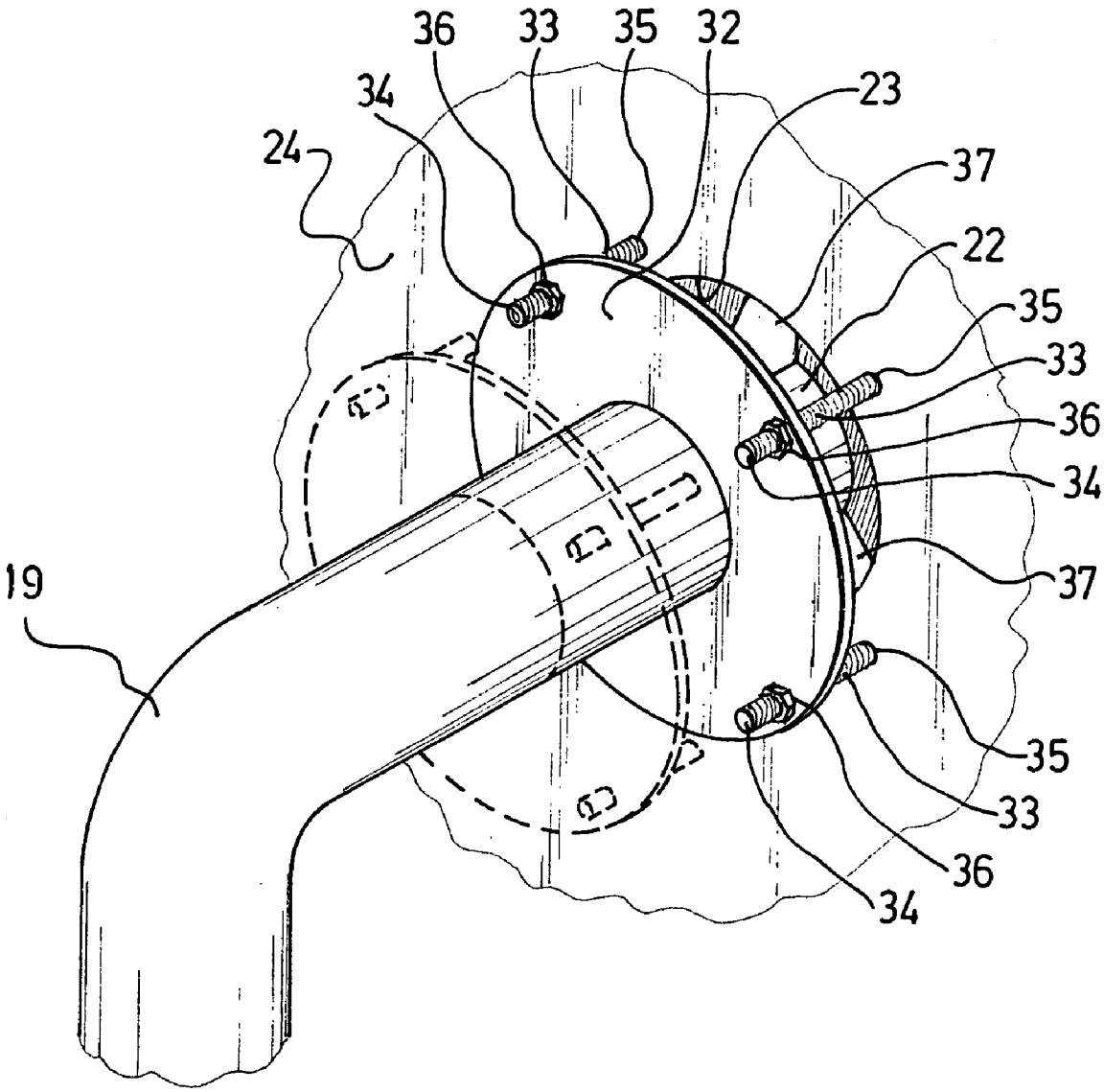
FIG. 5 is a schematic perspective detail view of the supply port of a double-acting pump of an installation according to the invention.

The control ring 32 is provided with a plurality of spacer studs 33 extending parallel to the axis of the end 22 of the return conduit 19 and of the supply port 23, i.e. perpendicularly to the wall 24. These studs 33 are fixed to the periphery of the ring 32 in its portion facing the wall 24 (extending radially beyond the supply port 23). Each spacer stud 33 has a free end 35 extending opposite the wall 24 and abutting said wall 24 under the effect of the hydraulic pressure resulting from the suction by the pump 26 of the liquid present in the bypass tank 20 between the control ring 32 and the peripheral edge of the supply port 23. The other end 34 of each spacer stud 33 is fixed to the control ring 32 via means for adjusting the length of the stud 33 extending between the ring 32 and its free end 35. These length adjustment means are formed, for example, by a screw/nut system. In the embodiment shown in FIG. 5, the spacer studs 33 are threaded studs screwed into corresponding internal threads formed in the control ring 32, and a locknut 36 is provided to lock each stud 33 in position. The spacer studs 33 also constitute means for maintaining the control ring 32 (in abutment against the wall 24) in a position that is fixed but adjustable with respect to the supply port 23.

Blades 37 firmly attached to the wall 24 and extending radially inwards from the peripheral edge of the supply port 23 are preferably provided, said blades 37 being distributed regularly around the axis of said port 23 so as to permit appropriate centering of the end 22 of the return conduit 19, which engages between said centering blades 37. Three centering blades 37 disposed at 120° to one another are, for example, provided.

When the useful length of the spacer studs 33 (between the ring 32 and their free ends 35 abutting the wall 24) is shortened, the ring 32 is moved closer to the wall 24 and the effective cross-section of flow of the bypass delivery is reduced. Therefore, if the position of the control valve 21 is not modified the pressure drop at the intake 25 of the pump 26 is increased, thus reducing the total delivery Q3 supplied by the pump 26. Moreover, the relation between the effective cross-section of flow of the filling delivery Q1 arriving at the end 22 of the return conduit 19 (which depends on the cross-section of said return conduit 19 and the position of the valve 21), and the effective cross-section of flow of the bypass delivery Q2 (which depends on the radial dimension of the supply port 23 outside the end 22 of the return conduit 19 and the position of the control ring 32), is determined by the given positions of the control valve 21 and the control ring 32. These different elements therefore allow both the total delivery Q3 supplied by the pump 26, and each of the filling Q1 and bypass Q2 deliveries, to be controlled.

Figure 4:
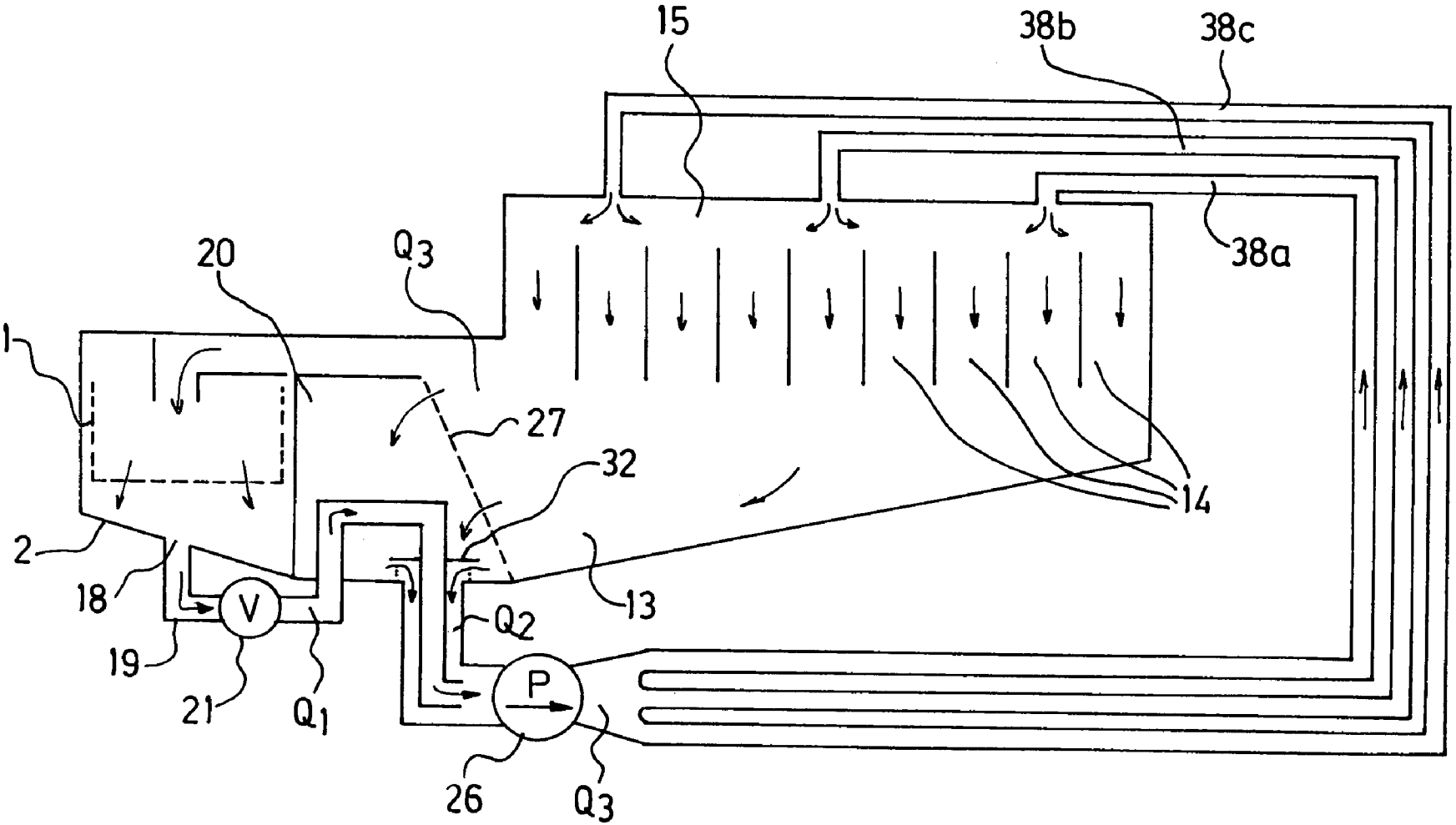
FIG. 4 is a diagram illustrating the principle of the hydraulic circuits of an installation according to the invention.

As shown in FIG. 4, the total delivery Q3 supplied by the pump 26 is recycled into the container 15 at a plurality of locations distributed regularly along said container 15 so as to provide homogeneous feeding of the different accumulation channels 14. In the example shown in FIG. 4, three recycling pipes 38*a*, 38*b*, 38*c* are provided, one of which 38*a* supplies the container 15 in its upstream portion, another 38*b* supplies the container 15 in its substantially median portion and the last 38*c* supplies the container 15 in its downstream portion. The delivery emerging from the different accumulation channels 14 is collected and recycled into the supply channel 13 and cumulated at the downstream end of the supply channel 13, in which the delivery Q3 supplied by the pump 26 is located. It should be noted that FIG. 4 is only a hydraulic circuit diagram showing the circulation of water and presenting inconsistencies from the graphic point of view (the filling device being shown schematically in vertical section while the pipes 38*a*, 38*b*, 38*c*, the container 15 and the accumulation channels 14 are shown in horizontal section).

As can be seen in any case, the invention enables the supply circuit and the filling circuit of the filling installation to be supplied by a single double-acting pump 26, preferably of the axial-flow type and having simplified maintenance.

It is self-evident that the invention may be the subject of numerous variants with respect to the embodiment described above and represented in the Figures. For example, there is no reason why a plurality of supply channels should not be provided on the same tank 2, either with a double-acting pump for each supply channel or even with a common double-acting pump for all the supply channels. A plurality of water outlets at the bottom of the tank may also be provided. The same tank 2 may serve for filling in parallel a plurality of crates 1 with a plurality of supply circuits. However, in all cases the use of such a bypass branch immediately upstream of the tank 2, and of a parallel supply to the same double-acting pump 26 by a bypass circuit and by the filling circuit, ensures a high degree of operating flexibility, simple construction and very great economy with regard to construction and operation.

The invention claimed is:

1. An installation for filling crates with floating objects, comprising:

a tank for receiving at least one crate to be filled;

a device for loading and unloading said at least one crate into and from the tank;

at least one supply channel for a water flow able to transport floating objects and connected to the tank to supply same;

a supply circuit, able to maintain in said at least one supply channel a water supply delivery (Q3), appropriate for transporting floating objects to the tank;

a filling circuit, able to maintain a water filling delivery (Q1), through the tank and into said at least one crate contained therein so as to introduce the transported floating objects thereto;

the filling circuit including at least one water outlet from the tank to provide the filling delivery (Q1), wherein:

the supply circuit includes at least one bypass branch from said at least one supply channel at an entrance to an upper portion of the tank, so as to divide the supply delivery (Q3) arriving at a downstream end of said at least one supply channel connected to the tank into a first component forming the filling delivery (Q1) and a second component forming a bypass delivery (Q2) that does not pass through the tank;

a filling and supplying pump for the filling circuit and for the supply circuit, the filling and supply circuits being adapted to feed said filling and supplying pump, firstly with the filling delivery (Q1) emerging from said at least one water outlet from the tank and secondly with the bypass delivery (Q2).

2. An installation as claimed in claim 1, wherein the filling and supplying pump is a double-acting pump, that provides the totality of the water circulation in the filling circuit and in said at least one supply channel.

3. An installation as claimed in claim 1, further comprising means for controlling the amount of the bypass delivery (Q2) supplying the filling and supplying pump.

4. An installation as claimed in claim 3, further comprising a control device for controlling the effective cross-section of flow of the bypass delivery (Q2) for supplying the filling and supplyig pump.

5. An installation as claimed in claim 1, wherein the filling and supplying pump includes an intake connected to a supply port formed through a wall of a bypass tank receiving the bypass delivery (Q2), wherein said at least one water outlet from the tank supplies a return conduit extending into the bypass tank and having an open end opening into the supply port, and wherein the cross-section of the supply port is greater than that of the end of the return conduit, so that a passage is formed between them for the bypass delivery (Q2) supplying the filling and supplying pump.

6. An installation as claimed in claim 5, which further comprises a control ring arranged around the end of the return conduit which is adapted to slide along said conduit and the dimensions of which correspond to those of the supply port, and means for maintaining the position of the control ring with respect to the supply port.

7. An installation as claimed in claim 1, which further includes a device for controlling the amount of the filling delivery supplying the filling and supplying pump from said at least one water outlet of the tank.

8. An installation as claimed in claim 1, wherein the filling and supplying pump is an axial-flow pump.

9. An installation as claimed in claim 1, wherein there is a single supply channel and a single bypass branch from the single supply channel at the entrance to the tank.

10. An installation as claimed in claim 1, wherein the supply circuit is adapted to recycle the supply delivery (Q3) supplied by the filling and supplying pump upstream of said at least one supply channel.

11. An installation as claimed in claim 1, which further comprises:

a container supplied by the supply delivery (Q3) provided by the filling and supplying pump;

a plurality of accumulation channels, connected to the container so as to be able to be supplied with water from said container and distributed regularly along a supply channel to supply the supply channel with water;

a unit for selectively feeding each accumulation channel with floating objects.

* * * * *